US005299905A

United States Patent [19]

Rademacher

[11] Patent Number: 5,299,905

[45] Date of Patent: Apr. 5, 1994

[54] ROPE DRUM DRIVING GEAR FOR A MOBILE MULTI-PURPOSE CHILD'S TOY

[75] Inventor: Albert Rademacher, München, Fed. Rep. of Germany

[73] Assignee: BIG-Spielwarenfabrik Dipl.-Ing. E.A.Bettag, Fed. Rep. of Germany

[21] Appl. No.: 889,675

[22] Filed: May 28, 1992

[30] Foreign Application Priority Data

Jun. 21, 1991 [DE] Fed. Rep. of Germany ... 9107674[U]

[51] Int. Cl.[5] ..... A63H 29/00; A63H 17/26

[52] U.S. Cl. ..... 414/624; 254/297; 446/425; 414/915

[58] Field of Search ..... 414/624, 626, 915; 446/425, 426; 254/297, 344; 242/283; 37/183 R, 115, 116, 135, 395, 396, 398, 461; 294/68.23

[56] References Cited

U.S. PATENT DOCUMENTS

| | | | |
|---|---|---|---|
| 78,927 | 6/1868 | Cristiansen | 254/334 |
| 1,273,747 | 7/1918 | Davidoff | 254/344 X |
| 1,386,885 | 8/1921 | McLair | 414/624 |
| 1,403,712 | 1/1922 | Schaudies | 254/344 |
| 1,573,203 | 2/1926 | Strohacker | 414/624 X |
| 1,635,162 | 7/1927 | Joyce | 254/297 |
| 2,864,200 | 12/1958 | Brutting | 446/425 |
| 3,939,033 | 2/1976 | McElroy | 254/297 |
| 3,985,340 | 10/1976 | Guangorena | 254/344 |
| 4,058,295 | 11/1977 | Morfitt | 254/297 X |
| 4,566,655 | 1/1986 | Young | 254/344 X |

FOREIGN PATENT DOCUMENTS

| | | | |
|---|---|---|---|
| G9101046 | 5/1991 | Fed. Rep. of Germany . | |
| 1254013 | 1/1961 | France | 446/426 |

*Primary Examiner*—David A. Bucci

[57] ABSTRACT

A rope drum gear for a child's toy, for example a toy crane, is constructed such that a child can operate an elevating mechanism and a grab spade by way of ropes via the drum gear. A crank handle for actuating the mechanisms is connected to a split rotating drum by way of crank case wheel. The hub of the crank case is constructed as a sun wheel of a planetary wheel gear, which planetary wheel gear is in turn connected with a first half of the split rope drum. The first half of the split rope drum is connected via a rope to the grab spade operating mechanism. The first half of the drum when rotated engages the second hair by way of a clutch mechanism, the second half of the drum connected by a rope to the elevating mechanism of the crane. In this way, a child can reproduce the operation of a full-scale crane in a manner easy to operate and understand for the child.

4 Claims, 3 Drawing Sheets

ROPE DRUM DRIVING GEAR FOR A MOBILE MULTI-PURPOSE CHILD'S TOY

BACKGROUND OF THE INVENTION

The invention refers to a mobile multi-purpose child's toy such a toy crane. The crane has lifting and opening mechanisms which are connected via ropes to a split rope drum driving gear, the two split halves of the drum being connected to each other by a clutch mechanism. In particular, the invention is adapted for easy operation by a child by providing a hand crank actuator which comprises a sun gear and a planetary gear.

A mobile multi-purpose child's toy has become known, the chassis of which is provided with an elevating mechanism from which a grab spade, such as is usually employed with dredgers, is suspended. Operation of said grab spade, therewith, is effected through a split rope drum, onto one half of which , a rope for elevation and, onto the other half of which, a rope for grab spade operation can be wound or unwound therefrom. By rotating a crank which is rigidly connected with said rope drum, the grab spade may be operated, i.e. opened and closed as well as raised and lowered. In order to render the effort required therefor, tolerable also for children, a loose roll is provided on said grab spade, with the aid of which translation of the required effort is ensured. The two halves of said rope drum are interconnected via a single-claw clutch so that there is the possibility of winding up the operating rope of said grab spade rather than that of unwinding same and that the spade jaws close before raising or open before lowering.

The effort required for raising and lowering, i.e. operating said grab spade is determined by the lever arm, which is given by the distance of the crank form the shaft of said rope drum, and halved once again by employing a loose roll on said grab spade (German Utility Model 91 01 046.2).

Due to employment of said loose roll for diminishing the required effort, the length of each of the two ropes is doubled, thereby necessitating a correspondingly large space for said rope drum when the entire rope length is wound onto the halves of said rope drum. Moreover, only a limited force translation ration can be realized by that design.

Given this prior art, it is the object of the invention to develop a mobile multipurpose child's toy, having an elevating mechanisms form which a grab spade is suspended, in such a way that, with a compact design, operation of said grab spade will become possible with an effort favorable to children.

SUMMARY OF THE INVENTION

By designing the crank wheel as an essential component of a planetary wheel gear, a favorable translation ratio can be achieved for operation of the grab spade with very small space being required. The gear wheel diameters and the numbers of the teeth can be adapted quite easily.

The loose roll on said grab spade can be dispensed with, since the necessary operating force of said grab spade can be sufficient reduced by the planetary wheel gear and, thus, only half of the rope length will have to be wound onto the rope drum or unwound therefrom. It goes without saying that, thereby, the rope drum diameter required with wound-up ropes will be reduced.

As is known, various translation ratios can be realized quite readily with the help of planetary wheel gears. This advantage may also be used in connection with driving of said grab spade. In such a case, it is merely necessary to provide additional shifting clutches and locking means on the hollow wheel and one the web of said planetary wheel gear. A special, favorable effect, therewith, is accomplished when a locking means and a shifting clutch are actuated at the same time so that upon locking of said hollow wheel, locking, favorably, being effected directly on the vehicle chassis, the shafting clutch, at the same time, disconnects the hollow wheel and the rope drum from each other. In this condition, driving of said rope drum is effected via the crank with the sun wheel, constructed in the form of a hub, through one several planet wheels toward the web and, thence, through the engaged shifting clutch toward the rope drum. Of course, the opposite case is also feasible, in which said web is locked and disengaged and transmission of the rotary motion is effected from the crank wheel via the sun wheel and the planet wheel toward the hollow wheel and, thence, through the shifting clutch toward the rope drum. Thereby, two translation rations can be realized in a simple way with a small space being required. In consequence of that, it is possible in particularly favorable a manner that, on the one hand, said web drive but the one half of the rope drum and that, on the other hand, said hallow wheel be able to be connected with the second half of said rope drum. In this case, the two different translation rations may be used correspondingly, i.e. the larger ratio is sued for raising and lowering of said grab spade and the smaller one is used only for operating said grab spade. The web of said planetary wheel gear, therewith, should extend on the common shaft within the rope drum diameter like a sleeve and should be connected with that half of said rope drum which is turned away from the crank. The connection of the hollow wheel with the other half of said rope drum may, therewith, be effected outside the internal diameter of said rope drum.

In order to ensure uncomplicated handling for children, the recommendation is given to combine the actuating means for locking and shifting of the clutch so that, except for the crank, only two more actuating elements are required for putting said grab spade in motion.

With a simplified form of construction, the shifting clutches may be omitted when the web is rigidly connected with one half of said rope drum and the hollow wheel is rigidly connected with the other half of said rope drum and when, on each of the two halves of said rope drum, a locking means is provided. According to actuation of these locking means, either the rope drum half for operating said grab spade or the rope drum half for raising and lowering said grab spade may, therefore, be driven. The locking means, therewith, may be designed such that it will lock either the one rope drum or the other rope drum so that only one actuating element is required.

BRIEF DESCRIPTION OF THE DRAWINGS

The invention will, hereinafter, be explained in more detail with regard to the drawings, which show.

DETAILED DESCRIPTION OF THE INVENTION

Figure 1:
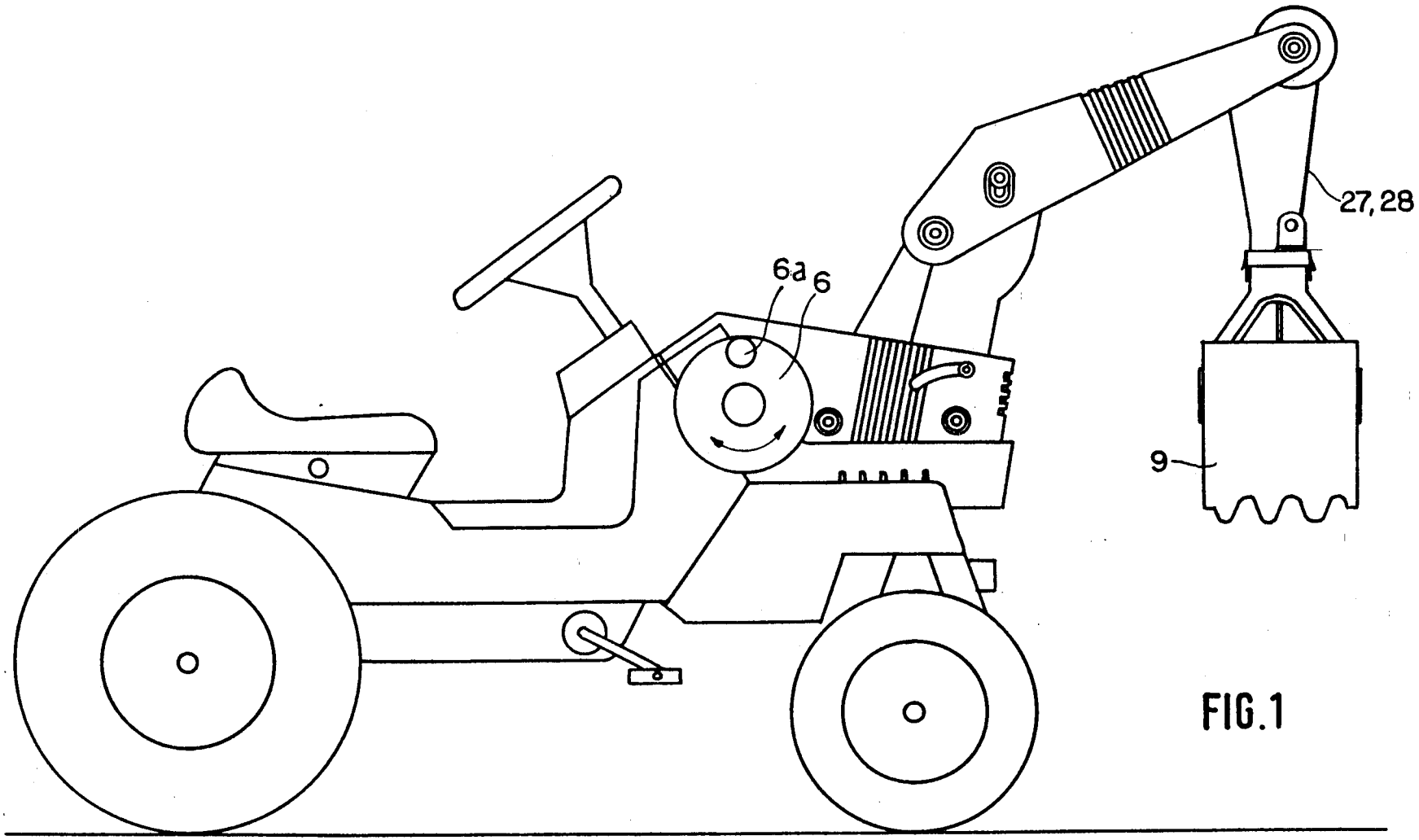
FIG. 1 a lateral view of the mobile multi-purpose child's toy.

By means of said mobile multi-purpose child's toy, such as is illustrated in FIG. 1, children, while sitting on the driver's seat, will be able to operate a grab spade 9 via a crank 6 by imparting a drive to one rope drum via said crank 6, which rope drum is split in two and by means of which raising and lowering, as well as opening and closing of said grab spade 9 can be carried out, while sitting on the driver's seat.

Figure 2:
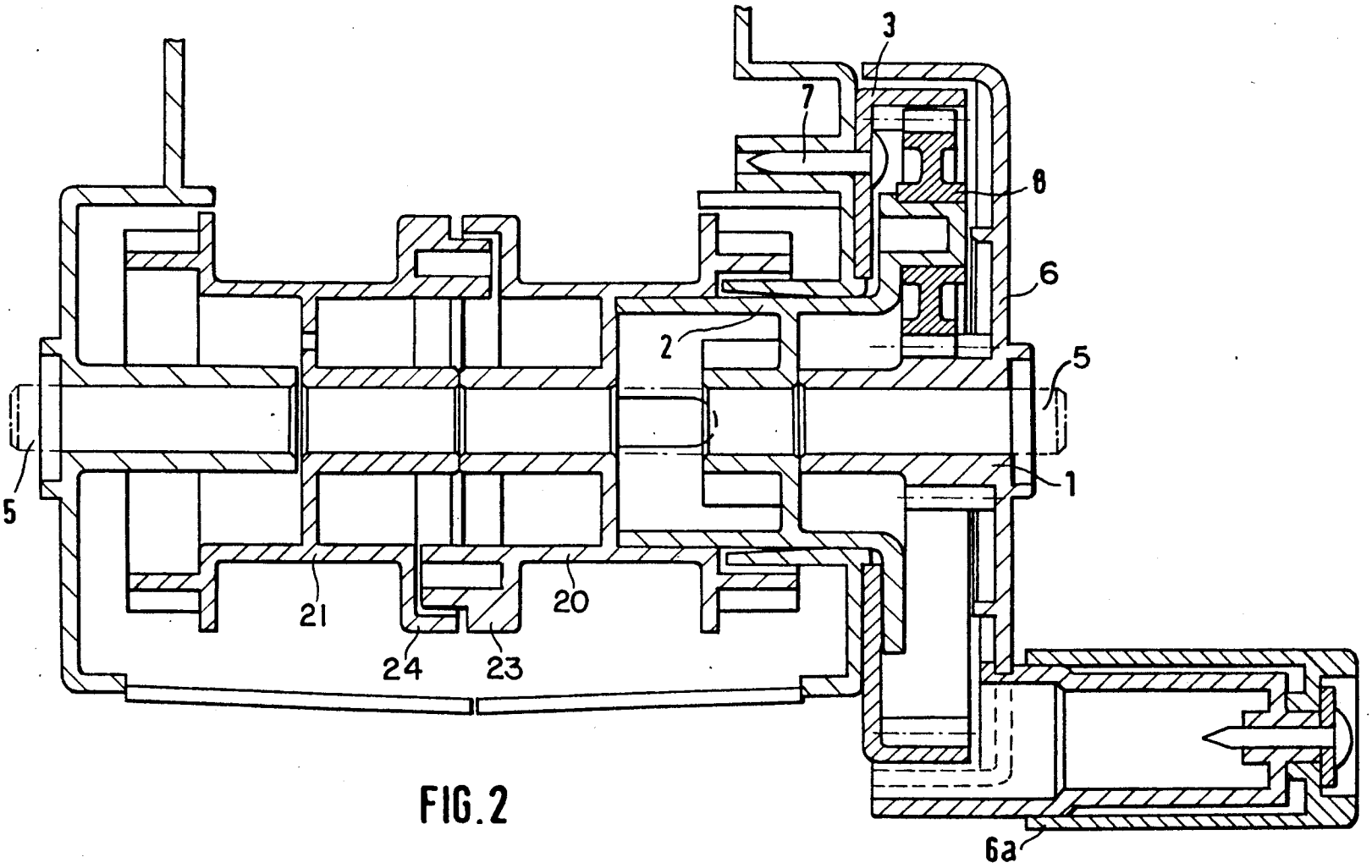
FIG. 2 a transverse section of the rope drum halves with the crank driving gear being designed as planetary wheel gear, and FIG. 3 an illustration of the rope drum split in two, with a cut-away portion showing the gear mechanism.

With the simplest form of construction, a planetary wheel gear is sued therewith (FIG. 2), having but one translation stage. In this case the planetary wheel gear is enclosed by the crank casing 6. When the crank handle 6*a* is rotated, the sun wheel 1, being in the form of a hub and being rigidly connected with said crank 6, will, via a set 8 of planet wheels, drive the pivoted web 2 that is rigidly connected with at least one half 20 or 21 of the rope drum. The hollow wheel 3, therewith, is fast with the vehicle chassis through a fixed locking element 7 and, therefore, cannot rotate. Translation of the rotary motion to the halves of the rope drum is effected int his case via the sun wheel 1, the planet wheels 8, and the web 2. The hub-like sun wheel component 1 of said crank 6, part of said web 2 and the two halves 20, 21 of said rope drum are pivoted on a common shaft 5 and secured against axial displacement. When transparent material is used for the crank casing, the children can visually observe the way of functioning of such a toothed-wheel gear and can comprehend the corresponding principle of functioning.

Figure 3:
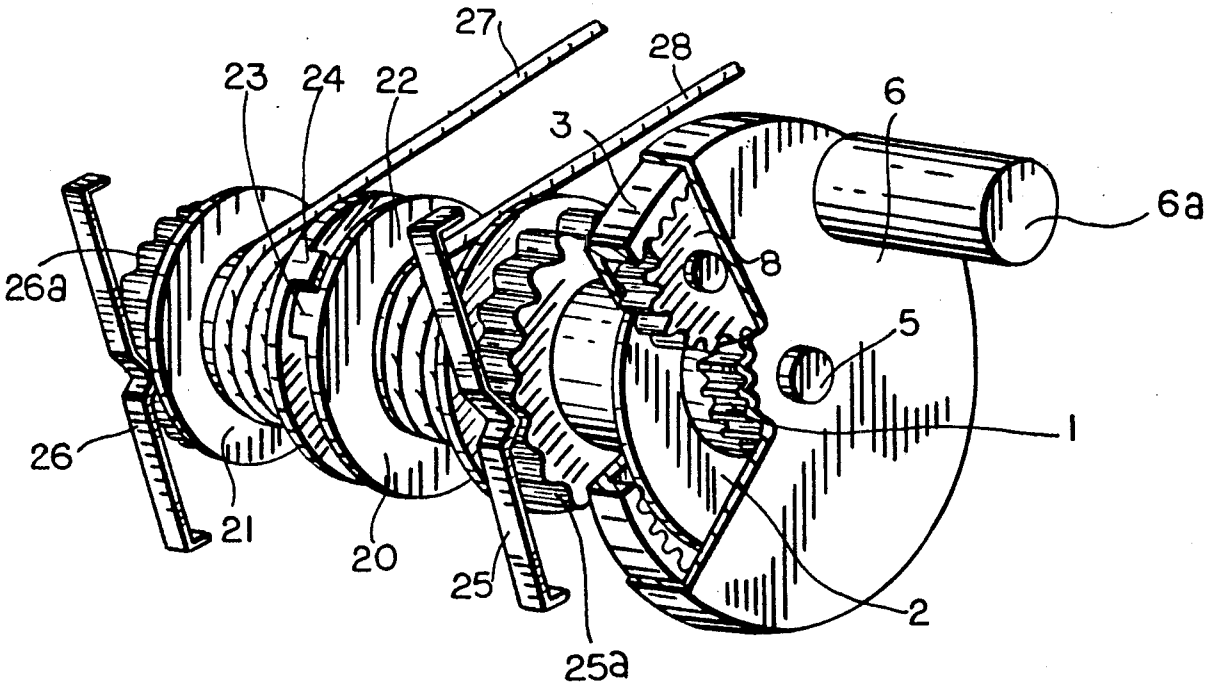

From the illustration according to FIG. 3, the way of functioning of the rope drum, split in two, can be drawn. In this case, driving of the rope drums 20, 21 is effected via the crank 6 and the planetary wheel gear coupled therewith. When the crank 6 is rotated, the first half 20 of said rope drum is rotated first and the grab spade-operating rope 28 is wound up or unwound before, after circa an almost complete revolution of the drum 20. The single-claw clutch 23, 24, being situated between both rope drum halves, moves the second half 21 of said rope drum and raising or lowering of said grab spade is effected via elevating rope 27. For automatic locking against accidental operation, ratchets 25, 25*a*, 26, 26*a* are provided.

I claim:

1. A rope drum driving mechanism for a child's toy crane having a grab spade which can be operated to change the elevation of the spade as well as to open and close the spade, said driving mechanism comprising a gear mechanism, the gear mechanism comprising a rotatable crank case having a crank handle extending therefrom for rotating the crank case, a hollow wheel fixed against rotation to a body of the crane, th- hollow wheel being housed coaxially within the crank case and having gear teeth about its inner circumference, the crank case housing a coaxial sun wheel gear attached thereto, the rotation of which sun wheel gear is actuated by rotation of the crank case, a planetary wheel gear situated between the sun wheel gear and the hollow wheel, the planetary wheel gear being connected to a rotatable drum connecting means coaxial with the sun wheel gear, such that upon rotation of the crank case, the sun wheel gear rotates and causes the planetary wheel gear to rotate and orbit about the sun wheel gear, a rope drum being connected to and rotated by the rotation drum connecting means, the rope drum being coaxial with the sun wheel gear the rope drum comprising a first drum adjacent the gear mechanism and a second drum adjacent the first drum, the first drum being connected by way of a first rope wound therearound to an opening and closing mechanism of the grab spade, and the second drum being connected by way of a second rope wound therearound to an elevating mechanism of the grab spade, the first drum being connected to the gear mechanism by way of the rotatable drum connecting means such that upon rotation of the crank case by way of the crank handle, the first drum rotates to thereby effect operation of the opening and closing mechanism, the first drum and second drum being connected by a clutch mechanism which allows for an almost complete rotation of the first drum before the second drum is thereafter engaged, whereby the grab spade is first opened or closed before being lowered or raised by way of the second drum, wherein both the opening and closing mechanisms and the elevating mechanism are operated by a single crank handle, and the rope drum is rotated at a rate lower than that of the crank case such that operation of both the opening and closing mechanism and the elevating mechanism of the crane is rendered more easily controllable for a child operator.

2. The rope drum driving mechanism of claim 1, further comprising ratchet means for operating in conjunction with the first drum and the second drum.

3. The rope drum driving mechanism of claim 1, wherein the crank case is transparent, so that operation of the gear mechanism is visible to the child operator.

4. The rope drum driving mechanism of claim 1, wherein the clutch mechanisms is a single claw clutch.

* * * * *